United States Patent [19]

Lane et al.

[11] 4,267,793

[45] May 19, 1981

[54] VELOCITY METER FOR BASEBALL BAT

[75] Inventors: Michael D. Lane, 2005 Huntington Cir., Ft. Collins, Colo. 80526; Kenneth J. Von Forell, Sr., Ft. Collins, Colo.

[73] Assignee: Michael D. Lane, Ft. Collins, Colo.

[21] Appl. No.: 106,699

[22] Filed: Dec. 26, 1979

[51] Int. Cl.[3] ..... A63B 69/00; G01P 15/02

[52] U.S. Cl. ..... 116/324; 73/492; 116/203; 273/72 R

[58] Field of Search ..... 116/324, 321, 314; 273/72 R, 183 D; 73/492, 379, 380, 493

[56] References Cited

U.S. PATENT DOCUMENTS

| | | | |
|---|---|---|---|
| 1,020,551 | 3/1912 | Harania | 73/379 |
| 1,026,990 | 5/1912 | Matson | 273/72 R |
| 2,106,994 | 2/1938 | Chapman | 73/380 X |
| 2,223,647 | 12/1940 | Stumpf | 73/493 X |
| 2,543,722 | 2/1951 | Hetzel | 73/493 X |
| 3,561,272 | 2/1971 | Davis | 73/492 X |
| 3,626,764 | 12/1971 | Prachar | 73/492 |
| 3,945,646 | 3/1976 | Hammond | 73/493 |

FOREIGN PATENT DOCUMENTS

| | | | |
|---|---|---|---|
| 373170 | 5/1932 | United Kingdom | 73/11 |
| 196383 | 7/1967 | U.S.S.R. | 73/492 |

*Primary Examiner*—Daniel M. Yasich
*Attorney, Agent, or Firm*—Hugh H. Drake

[57] ABSTRACT

A baseball bat has its handle, shaped to be grasped by the hand of a user, extending on into an enlarged hitting portion that continues away from the handle. Included in that hitting portion is a velocity meter situated in a cavity that extends longitudinally inward toward the handle from the outer end. A plunger is slidably received within that cavity and is resiliently held in place. Also included is an indicator which informs as to the amount of movement of the plunger outwardly from within the cavity as a result of the swinging of the bat by the user.

5 Claims, 4 Drawing Figures

VELOCITY METER FOR BASEBALL BAT

The present invention pertains to a velocity meter for a baseball bat. More particularly it relates to a velocity meter installed within a baseball bat for the purpose of indicating the velocity of the swinging of the bat by the user.

The performance of the game of baseball involves, as one essential element thereof, an attempt by a person swinging an elongated bat to connect with and hit away a ball hurled toward the batter by a pitcher. The bat is normally of round cross section and has a diameter of the same order of magnitude as that of the ball which is hurled. A national, and indeed even an international, sport has developed as a result of the fact that it is not nearly as easy to hit that ball appropriately as it might look to a person who observed the action for a first time.

A pitcher can deliver the ball toward the batter at a speed which has been measured in terms of up to around one hundred miles per hour. The pitchers also have mastered techniques which involve a much slower delivery but, adapting laws of physics as applied to the movement of objects, cause the balls to move, or at least appear to move, in other than a linear flight path. Whatever the kind of movement of the ball, or its speed, the ball cannot be hit well by the bat unless the ball is squarely met by the bat and the bat is being swung at a high velocity.

The sport has been finely honed as an art while yet also having aspects of a science. The coaching of the players has required an ability on the part of the coaches not only to use the physics of what amounts to the science of ballistics but also to become students of the anatomy of the would-be batters, so as best to guide them in how to achieve the objective of swinging the bat to greatest advantage. Historically, some participants have had the ability to perform well as batters without a great deal of instruction. Others have shown improvement over a period of years through the usual result of lots of practice. Especially in this latter category, it is now pretty well accepted that the eye of a trained coach, practicing his art, can yield beneficial results by way of advice to the batter.

In this combination of art and science which is the coaching of baseball, those who have enjoyed that profession have found that a successful result most often is the combination of properly coallating a host of different things each of which, in itself, may seem to be trivial. It, of course, involves such things as the stance taken by the batter, the placement of his feet, the manner in which he holds his arms in preparation to bat, the way in which his hands grip the bat and even the way in which he wears his clothing. One inescapable element in all of this, however, is that the hit ball is not going to depart any faster than a proportion of the velocity with which the bat is swung.

In view of the foregoing, the batting coach seeks to aid the performers in increasing the speed with which the bat is swung. Again, the success of that endeavor involves suggestions for adjustment of all manner of approach, ranging from the placement of the feet on the ground to the cocking of the wrists and elbows with respect to the bat. In attempting to do that coaching during practice, the coach is inherently limited by having to depend upon his sense of vision to determine if any particular suggestion has actually resulted in an increase in the speed of the swing. Often, it is only after many weeks of play that the coach can be at all certain whether his efforts have been beneficial. That is, the coach is not able to observe accurately by eye the difference between a fifty mile per hour and a seventy mile per hour swing. Therefore, for example, he can't tell for sure whether a given suggestion for a try at a wrist repositioning actually has the desired effect.

Responsive to the foregoing, it is a general object of the present invention to provide the coach, or even just the batter himself, a means of determining immediately the velocity of the batter's swing.

Another object of the present invention is to provide such a device which may be readily installed in existing bats with minimal expense.

The invention, accordingly, has to do with a baseball bat that has a handle shaped to be grasped by the hands of a user. It includes a hitting portion that continues away from the handle. A velocity meter included therein involves means that defines a cavity extending longitudinally inward toward the handle from an outer end of the hitting portion. Slidably received within the cavity is a plunger. That plunger is resiliently held within the cavity. Most importantly, there is an indication of the amount of movement of the plunger outwardly within the cavity as a result of the swinging of the bat by the user.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements and in which:

Figure 1:
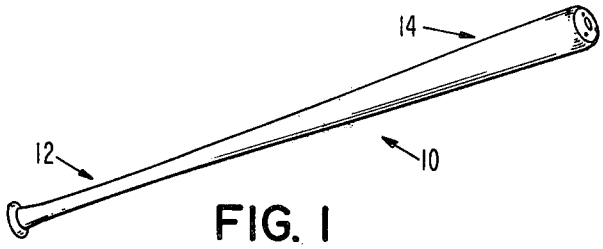
FIG. 1 is an isometric view of a baseball bat into which the present invention has been incorporated.

An ordinary baseball bat 10 has a handle 12 shaped to be grasped by the hands of a user. The bat continues from handle 12 into a hitting portion 14. Extending longitudinally inward from the outer end of hitting portion 14 is a cavity 18. Seated within cavity 18 is a sleeve 20.

Figure 4:
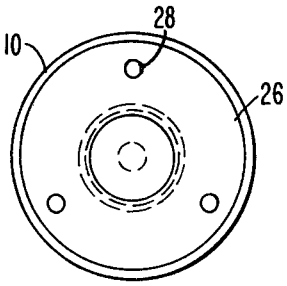
FIG. 4 is an end elevational view of the bat.

Slidably received within sleeve 20, and thus within cavity 18, is a plunger 22. A spring 24 serves to resiliently hold plunger 22 in place within sleeve 20. In this particular case, sleeve 20, plunger 22 and spring 24 are all held into place by a cap 26 secured into the outer end of the bat by screws 28 as particularly shown in FIG. 4.

Demarcations 30-34, inscribed on the length of plunger 22, correspond respectively to hitting speeds of sixty through one-hundred miles per hour, in steps of ten. These demarcations are visible from outside the bat when plunger 22 has been extended outwardly beyond cap 26.

Secured on the inner end of plunger 22 is a tapered plug 40 that terminates in an enlarged piston 42. Plug 40 defines an inclinded plane 44. Seated within the space defined between plug 40 and sleeve 20 are a plurality of balls 46.

Figure 3:
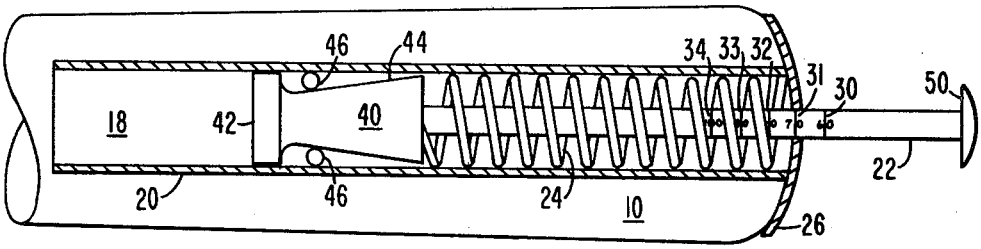
FIG. 3 is a view similar to FIG. 2 but with certain parts in a different position.

When the bat is swung at a normal speed for hitting a ball, plunger 22 is driven outwardly against the force of spring 24 so as to expose its head 50 beyond cap 26 as shown in FIG. 3. Just the amount by which head 50 was exposed beyond the end of the bat would afford a coach a general measurement correlated to the speed of swinging of the bat. In this case, however, plunger 22 is held outwardly as a result of a wedging action between balls 46 and sleeve 20 as urged by inclined plane 44 on plug 40. More particularly, the indicated demarcation lines 30–34 are so placed as to be alignable with the outer surface of cap 26 and thereby afford the coach a direct reading of what had been the velocity of the swing.

Figure 2:
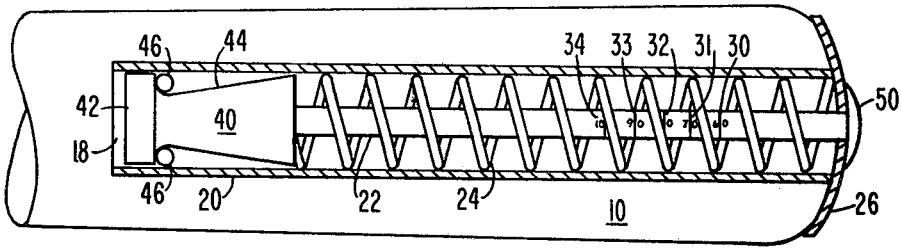
FIG. 2 is a fragmentary and enlarged cross-sectional view of a portion of the bat of FIG. 1.

The wedging mechanism or locking means afforded by plug 40 is self-releasable. That is, the user need only make a slight pull upon plunger 22, with the bat held so that its outer end is upright, to allow the balls to fall downwardly against piston 42 and release the wedging action. This permits the plunger to be restored to its rest position as shown in FIG. 2 and be ready for measurement with regard to another swing.

Of course, bats may be constructed to include mechanisms of the kind described as an original and continuing element. However, it is the experience in the art of baseball that a given batter will have acquired a preference for a given make and model of particular bat. Moreover, bats are frequently broken. In keeping with that experience, the device hereindescribed is intended to be placed into an existing bat at the scene of activity. That is, an existing bat is drilled or cored so as to accept sleeve 20 in place of the removed material. To that end, the entire assembly of sleeve 20 and its included plunger 22, spring 24 and plug 40, as well as cap 26, preferably is selected to have a weight equivalent to that of the material which has been removed by drilling or coring so as to allow insertion of the assembly.

In any case, the use of the device requires that the batter take a swing. Both he and the coach can then observe the velocity obtained. Even without necessarily responding to a pitched ball, the batter can make coach-assisted changes in stance, manner of holding or whatever and then take a new swing and get a new reading. The result is quickly to lead both the batter and the coach to determine what changes, for the given individual batter, are most desirable for the purpose of achieving maximum swing velocity.

While a particular embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

We claim:

1. A velocity meter comprising:

a baseball bat having a handle, shaped to be grasped by the hands of a user, and a hitting portion continuing away from said handle;

means defining a cavity extending longitudinally inward toward said handle from an outer end of said hitting portion;

an elongated plunger means slidably receivable within said cavity, said plunger means including a tapered plug means rigidly affixed thereto and movable therewith slidably within said cavity;

means for resiliently holding said plunger means within said cavity;

means on the bat coacting with indicating means on said plunger means for indicating the amount of movement of said plunger means outwardly from said cavity as a result of a swinging of said bat by said user;

and means for automatically locking said plug means in the position of maximum amount of movement within said cavity during said swinging, to enable maintaining the indication of said movement following said swinging of said bat.

2. A velocity meter as defined in claim 1 in which said locking means is self-releasable upon manual further extension of said plunger means.

3. A velocity meter as defined in claim 1 which includes a hollow sleeve seated within said cavity, mounted longitudinally within said hitting portion and within which said plunger means is disposed.

4. A velocity meter as defined in claim 3 which further includes a cap, secured on the other end surface of said hitting portion, for confining said sleeve in position.

5. A velocity meter as defined in claim 1 in which the combination of said plunger means, said holding means, said indicating means and said locking means has a weight equivalent to the weight of the material of said bat removed to enable formation of said cavity.

* * * * *